US005738214A

United States Patent [19]

Wyss

[11] Patent Number: 5,738,214

[45] Date of Patent: Apr. 14, 1998

[54] PART FOR A TWOPARTITE BOX, A BOX OF TWO SUCH PARTS AND A SET OF SUCH PARTS

[75] Inventor: Patrick Wyss, Starrkirch, Switzerland

[73] Assignee: Impex Patrick Wyss, Monchaltorf, Switzerland

[21] Appl. No.: 559,336

[22] Filed: Nov. 16, 1995

[30] Foreign Application Priority Data

Oct. 6, 1995 [EP] European Pat. Off. ..... 95115787

[51] Int. Cl.[6] ..... B65D 85/28

[52] U.S. Cl. ..... 206/373; 206/372; 220/23.83

[58] Field of Search ..... 206/372, 373, 206/818; 220/23.83, 342, 343, 264; 150/115, 117

[56] References Cited

U.S. PATENT DOCUMENTS

| | | | |
|---|---|---|---|
| 1,198,524 | 9/1916 | Cunliffe | 220/343 |
| 2,013,852 | 9/1935 | Odendahl | 220/343 |
| 3,126,120 | 3/1964 | Crate | 220/343 |
| 3,334,714 | 8/1967 | Gordon | 190/117 |
| 3,749,301 | 7/1973 | Peckar | 206/818 |
| 4,615,464 | 10/1986 | Byrns . | |
| 4,938,355 | 7/1990 | Rocco | 206/373 |
| 5,067,625 | 11/1991 | Numata | 220/343 |
| 5,274,881 | 1/1994 | DeRosa . | |
| 5,394,913 | 3/1995 | Zezza, Jr. et al. | 220/343 |

FOREIGN PATENT DOCUMENTS

| | | | |
|---|---|---|---|
| 124446 | 11/1984 | European Pat. Off. | 206/372 |
| 3030756 | 3/1982 | Germany . | |
| 3148986 | 6/1983 | Germany . | |
| 662487 | 10/1987 | Switzerland . | |

*Primary Examiner*—David T. Fidei

*Attorney, Agent, or Firm*—Pearne, Gordon, McCoy & Granger LLP

[57] ABSTRACT

Boxes with compartments for individual articles that can be assembled in a flexible manner include a pair of box parts each having at least one hinge portion in which hinge knuckles alternate with open sections or recesses. A knuckle is located at one end of the hinge portion and, at the other end, an open section without a knuckle is provided.

10 Claims, 2 Drawing Sheets

PART FOR A TWOPARTITE BOX, A BOX OF TWO SUCH PARTS AND A SET OF SUCH PARTS

BACKGROUND OF THE INVENTION

1. Field of the Invention

The present invention relates to a box part for a box with compartments made of a plastic material and adapted to receive parts of a set of parts, such as for instance sets of wrenches, sets of drill bits, sets of screw drivers, etc. The box includes two box parts to which hinge sides structured substantially rectilinearly are mounted by means of a hinge, whereby each box part includes at least two hinge knuckles of the same length in the direction of the axis of the hinge, which leave a section open between themselves.

The invention relates further to a box, designed with two of the mentioned parts, and to a set of at least three such box parts, as well.

2. Description of the Prior Art

Plastic boxes of the kind set forth above, at which into at least one of the parts plastic compartments are formed are known. Thereby, boxes which include a casing part in which inserts are releasable received i.e. inserts for chocolate sweets are of minor interest. Rather, boxes in which compartments are formed into the in this respect, integrally structured box parts are of relatively more interest.

Such boxes include along respective hinge portions each a respective, projecting hinge knuckle of the same length which, considering each part on its own, leave sections free between them, into which the knuckles of the other or complementary hinge part mesh.

It is, thereby, common that, as seen proceeding from one end of the hinge portion of one of the box parts, hinge knuckles and open sections designed with the same lengths follow each other, so that either at both ends of the hinge portion one respective knuckle is foreseen, or a respective open or knuckle-less section for the receipt of a knuckle of the other part. These box parts are connected to each other by a substantially non-detachable hinge connection.

Due to this design, a respective box of the mentioned known kind determines in a final manner, with its plastic compartments in preferably both box parts, which articles can be received in the box.

SUMMARY OF THE INVENTION

It is an object of the present invention to provide box parts which can be assembled flexibly and interchangebly into a box. In accordance with the present invention, entire boxes with sets of articles belonging thereto no longer need to be sold as an assembled box, but rather a person purchasing such a box can assemble, in accordance with his specific need, box parts with the desired compartments and therewith articles in a "modular" manner and can complete assembly of the box in a simple manner. In the same manner, artisans shall be in a position to put a box together in accordance with their needs, so that the specifically needed tool parts may than be received united therein.

A further object is to provide in a simple manner a box part, proceeding from the box parts described above, which includes along the hinge portion at the box part at the one end a hinge knuckle and, at the other end, a recess for a hinge knuckle, and at which at least one section foreseen between hinge knuckles is at least of the same length as the hinge knuckles.

By means of such design it will become possible to freely connect two box parts according to the present invention. It is possible to equip box parts which are designed in the same manner with regard to the hinge portion with completely differently patterned compartments and to complete flexibly two respective box parts corresponding to the prevailing needs to one box.

Although the releasability of the individual box parts can also be realized by corresponding projecting structures and recessed structures at the knuckles in the direction of the axis of the hinge similar to spring-bolt locks, it is preferred that the fishings define at least one substantially closed through opening in mentioned direction of the axis. Furthermore, the mentioned box part is produced preferably integrally of a plastic material and includes at one planar side the recipients. A box in accordance with the invention with two of the mentioned box parts includes, furthermore, at least one hinge pin which can be pulled out and which interconnects the knuckles at the respective box parts in a hinge like manner and forms preferably together with the knuckles a spring-bolt lock.

In further accordance with the present invention, the box parts are connectable at the hinge, but complimentary locking parts are provided. In accordance with a first variant in that removable lock portions are provided by magnets which can be set or clamped, into corresponding compartments at the box parts.

In a further preferred embodiment the box parts include at two oppositely to each other locates sides hinge portions of mentioned kind, with open sections and knuckles, whereby the knuckles and open sections at a hinge section are staggered relative to the other one. The knuckles include, thereby, also here through bores wherewith a box can be assembled from two of the last mentioned box parts, in that each hinge area of each parts is hingedly connected by pins and the hinge sections at the sides of the not interconnected parts are used with the identical pins as closure portions. By means of this a very high flexibility is arrived at regarding assembling the boxes as desired.

Furthermore, a set of at least three of the inventive parts is suggested, which include different compartments for differing sets of articles.

BRIEF DESCRIPTION OF THE DRAWINGS

The present invention will be better understood and objects other than those set forth above will become apparent when consideration is given to the following detailed description and drawings, wherein.

DETAILED DESCRIPTION OF THE PREFERRED EMBODIMENTS

Figure 1:
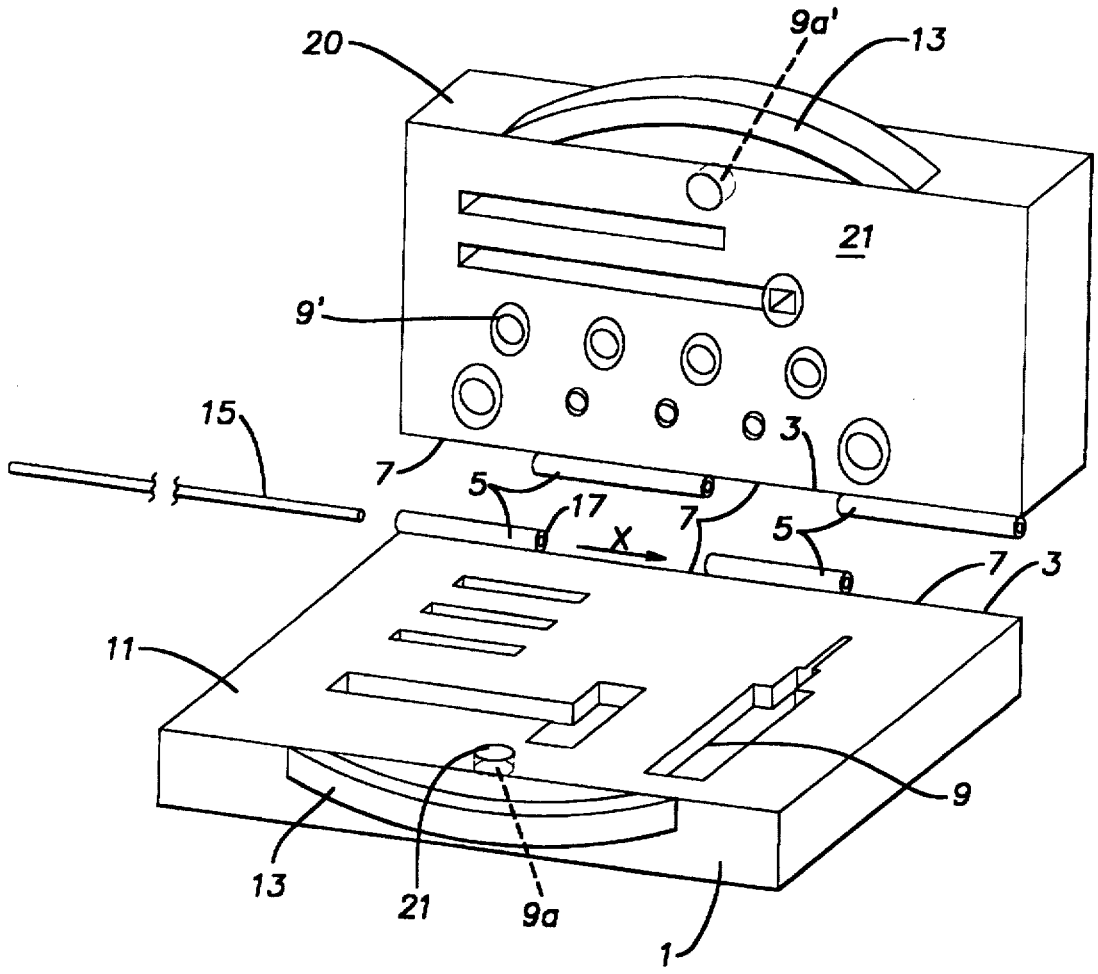
FIG. 1 is an exploded perspective view of a first embodiment of a box structured in accordance with the present invention.

FIG. 1 illustrates perspectively a first box structured in accordance with the invention with two box parts structured in accordance with the invention in a first form of realization.

A first part 1, formed preferably integrally of a plastic material, includes a hinge portion 3 which extends in a rectilinear manner onto which at least one, preferably two or more hinge knuckles 5 are formed. Along the hinge portion 3, proceeding in the direction x of the axis of the hinge portion, a knuckle 5 is foreseen at one end of the hinge portion 3, whereas a knuckle-less or open portion 7 is foreseen at the other or opposite end of the hinge portion 3. Knuckles 5 and open 7 without knuckles are foreseen along the hinge portion 3, whereby, as seen in direction x, all knuckles and knuckle-less or open portions 5 and 7, resp. are of substantially the same length, or the open portions 7 are of a greater length.

Recipients or compartments 9 for the parts of a set of tools are formed in at the part 1. A holding loop or handle 13 is formed flush at the planar side 11 of the part 1 into which the compartments are formed. The holding loop 13 is provided on a side of the part 1 which is opposite the hinge portion 3, as illustrated.

The second part 20 of the box structured in accordance with the present invention is designed specifically, with regard to the hinge portion 3, in the same manner as the portion 3 at the first part 1 described above. Accordingly, these two parts 1 and 20 can be interconnected and connected together by a inserting of a releasable hinge pin 15 through openings 17 in each hinge knuckle 5. In the second part 20 compartments 9' are formed to correspond with the articles or tools which will be received therein. Accordingly, the compartments 9' may have the same or different shape as the compartments 9 of the first part, depending upon whether the second part 20 receives the same or a different set of articles, specifically tool parts.

The lock or latch of the box parts 1 and 20 assembled to a box is realized e.g. by means of removable locking members an each part 1,20, e.g. by permanent magnets 21 which are set into corresponding compartments 9*a* and 9*a'*.

As can be seen, the same tools can be used for the production of the outer shapes of the box parts 1, 20 with the hinge portions. The box parts 1 and 20 can be assembled freely, and as needed depending upon the sets of articles to be received.

Figure 2:
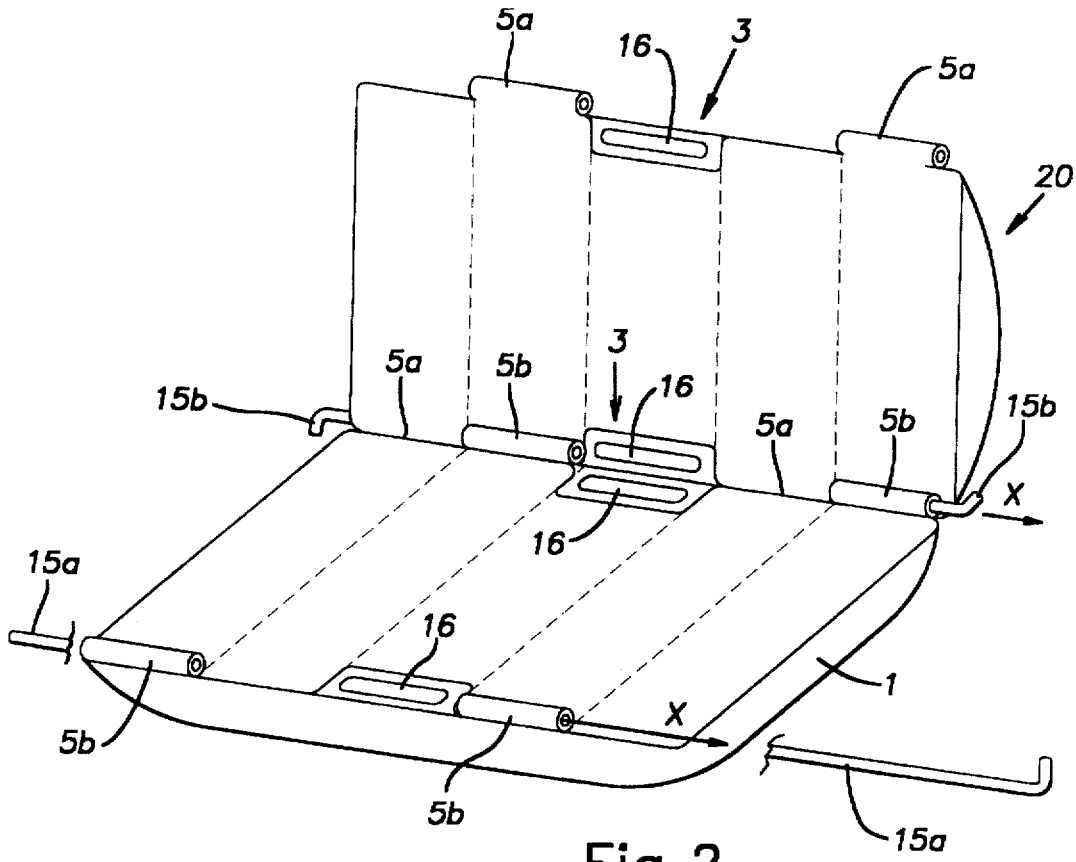
FIG. 2 is a perspective view of a second preferred embodiment of a box structured in accordance with the present invention.

In FIG. 2 and in a illustration analogue to FIG. 1, a preferred embodiment of the box of the invention with a correspondingly preferred design of its box parts is shown. For the parts which, regarding their function, are similar to the parts of the box of FIG. 1 the same reference numerals are used. The box parts 1 and 20 each include two hinge portions 3 which are located opposite each other along parallel sides. Along the hinge portions 3 foreseen at one part 1 or 20, resp., the knuckles 5 alternate with open sections 7 such as is illustrated in FIG. 2 by the arrangement entered by broken lines. Preferably, at both sides of each box part 1, 20 a respective part of a holding recess 16 is provided.

Figure 4:
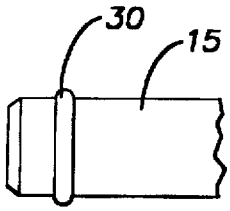
FIG. 4 illustrates shown in design for the pins for the boxes shown in FIGS. 1 and 2.

As can be seen, these parts can now be assembled completely freely and additionally a hinge portion 3 operates as a as hinge whereas the other hinge portion 3 acts as locking portion. Hereto, preferably the same pins 15*a* and 15*b*, resp., are utilized for forming the hinge as well as the lock, which pins form a snap coupling with the respective knuckles 5 and are equipped for this task for instance with a snapping ring 30 at their ends (FIG. 4).

Figure 3:
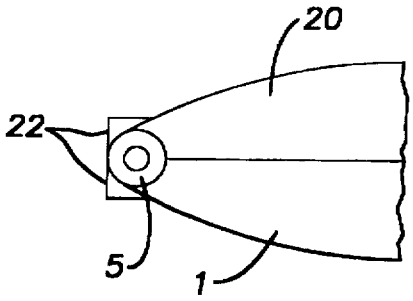
FIG. 3 illustrates a lower section of the box shown in FIG. 2 in a closed state.

Preferably, and as shown in FIG. 3, the hinge knuckles 5 are formed into the rounded shape of the parts 1 and 20, resp., which latter include respective supporting projections 22 in order to allow the box structured in accordance with the invention and the narrow side where the hinge is located.

Furthermore, (not illustrated) marking sliders could be foreseen at the outer side of the box, by means of which, flexibly, it can be indicated for instance by selectively coverable arrow marking, which portion is the hinge portion and which portion is the lock portion, such that, depending from the contents of the box, it is always opened at the correct side.

While there are shown and described present preferred embodiments of the invention, it is to be distinctly understood that the invention is not limited thereto, but may be otherwise variously embodied and practiced within the scope of the following claims.

I claim:

1. A set of at least three halves of a plastic material box, at least two of said halves comprising compartments, each of said compartments adapted to snugly receive specific products of a predetermined shape, said products forming a product set respectively for said at least two of said halves, each of said at least three halves comprising a linearly extending hinge portion having first and second ends, said hinge portion comprising a first hinge knuckle at said first end of said hinge portion and at least one second hinge knuckle spaced from the second end of said hinge portion by a first distance and wherein of said knuckles have a first length which is equal to a space between adjacent knuckles and wherein said first distance is equal to or greater than said first length, so that each of said at least three halves may be pivotally hinged to any of the remaining at least two halves along their respective hinge portions and a first product set stored in one of said at least three halves may be freely combined with another product set stored in another of said at least three halves in a box formed by two of said at least three halves.

2. The set of claim 1, wherein said knuckles define respective through openings extending in the direction of said first length.

3. The set of claim 1, wherein one of said halves is made of one piece.

4. The set of claim 1, wherein one of said halves has one of said hinge portions along opposite sides thereof.

5. The set of claim 1, wherein one of said halves comprises a handle portion.

6. The set of claim 4, further comprising a handle portion adjacent each of said hinge portions.

7. The set of claim 4, wherein first and second halves each have first and second oppositely located hinge portions and wherein there are provided first and second pin arrangements, said first pin arrangement defining a pivotable link between said first hinge portions of said first and second halves and said second pin arrangement defining a lock that is introduced into said second hinge portions of said first and second halves.

8. The set of claim 1, wherein one of said halves comprises a removable locking portion.

9. The set of claim 8, wherein said removable locking portion is formed by a removable magnetic piece.

10. The set of claim 1, wherein said products are tools.

* * * * *

UNITED STATES PATENT AND TRADEMARK OFFICE

CERTIFICATE OF CORRECTION

PATENT NO. : 5,738,214

DATED : April 14, 1998

INVENTOR(S) : Wyss

It is certified that error appears in the above-identified patent and that said Letters Patent is hereby corrected as shown below:

Title page, item [30] Foreign Application Priority Data, delete "95115787" and insert --95115787.4--.

Column 1, line 25, after "sweets" insert --,--.

Column 1, line 26, "the" insert --,--.

Column 2, line 56, delete "shown in" and insert --a preferred--.

Column 3, line 7, after "open" insert --section--.

Signed and Sealed this

Twenty-fifth Day of August, 1998

Bruce Lehman

*Attest:*

BRUCE LEHMAN

*Attesting Officer*

*Commissioner of Patents and Trademarks*